US007381087B2

(12) United States Patent
Alvarez

(10) Patent No.: US 7,381,087 B2
(45) Date of Patent: Jun. 3, 2008

(54) CONNECTOR ASSEMBLY

(75) Inventor: Bryce K. Alvarez, Milpitas, CA (US)

(73) Assignee: Realm Communications Group, Milpitas, CA (US)

( * ) Notice: Subject to any disclaimer, the term of this patent is extended or adjusted under 35 U.S.C. 154(b) by 0 days.

(21) Appl. No.: 11/185,515

(22) Filed: Jul. 19, 2005

(65) Prior Publication Data

US 2007/0020994 A1 Jan. 25, 2007

(51) Int. Cl.
*H01R 13/60* (2006.01)

(52) U.S. Cl. ..... 439/540.1

(58) Field of Classification Search ..... 439/540.1, 439/344, 353, 497, 492, 701; 385/85, 53, 385/56; D13/133
See application file for complete search history.

(56) References Cited

U.S. PATENT DOCUMENTS 5,692,925 A * 12/1997 Bogese, II ..... 439/620
6,109,978 A 8/2000 Stellman et al.
6,123,564 A * 9/2000 Belmore, III ..... 439/344
6,250,817 B1 * 6/2001 Lampert et al. ..... 385/56
6,343,950 B1 2/2002 Eginton et al.
6,357,934 B1 * 3/2002 Driscoll et al. ..... 385/86
6,419,526 B1 * 7/2002 Fair et al. ..... 439/676
6,547,585 B2 * 4/2003 Bradley et al. ..... 439/353
6,595,798 B1 7/2003 Pook
6,857,900 B2 2/2005 Kleeberger et al.

* cited by examiner

*Primary Examiner*—Alexander Gilman
(74) *Attorney, Agent, or Firm*—Sawyer Law Group LLP

(57) ABSTRACT

A connector assembly. The connector assembly includes a body, a plurality of connectors coupled to the body, where the plurality of connectors are adapted to couple to a plurality of respective sockets, and a release structure coupled to the body, where the release structure enables the plurality of connectors to decouple from the plurality of respective sockets. According to the system disclosed herein, the connector assembly facilitates convenient and efficient connection and disconnection of a set of connectors with latches and a set of sockets.

49 Claims, 10 Drawing Sheets

300

CONNECTOR ASSEMBLY

FIELD OF THE INVENTION

The present invention relates to electronic equipment, and more particularly to a connector assembly.

BACKGROUND OF THE INVENTION

Devices for holding arrays of electrical or optical latching connectors, such as RJ-11 or RJ-45 connectors, are well known. These devices facilitate connection and disconnection of connectors to and from corresponding sockets in electrical equipment, such as telephone and data network switches.

Ganged connectors greatly facilitate the testing of equipment where many connectors and sockets must be connected and disconnected, such as in a production environment. A problem with conventional ganged latching connectors is that connecting and disconnecting multiple connectors and sockets can be labor intensive.

One conventional solution provides a connector holder and a latch release bar coupled to the connector holder. RJ-45 connectors are mounted in the connector holder for simultaneous insertion into corresponding sockets. The latch release bar is manipulated to simultaneously depress a latch of each connector in the connector holder. A problem with this conventional solution is that is it difficult to use. It also requires many parts, which adds unnecessary complications when building the holder. Having so many parts increases the cost to produce and to assemble.

Another conventional solution provides a device having a connector holder with openings to allow manual release of the connector latches. RJ-45 connectors are mounted in the holder for simultaneous insertion into corresponding sockets. The openings allow clearance for a user's fingers to depress the latches of connectors, while an apparatus is provided to selectively depress or release the latches of the remaining connectors. A problem with this conventional solution is that it requires two operations to disengage the latches. Also, it requires two hands to operate. This makes it difficult to extract the connectors, especially when the number of connections gets larger.

Another problem with connecting connectors with sockets is that sockets can come from different manufacturers. Accordingly, the specific spacing between sockets vary, especially between rows of sockets. The conventional solutions do not address this problem. If a connector is loosely connected with a socket due to misalignment, the electrical connection may fail. Also, there is a likelihood of wear and galling created by the sliding of the connectors in their fittings.

Accordingly, what is needed is an improved system for connecting and disconnecting connectors and sockets. The system should be simple, cost effective and capable of being easily adapted to existing technology. The present invention addresses such a need.

SUMMARY OF THE INVENTION

A connector assembly is disclosed. The connector assembly includes a body, a plurality of connectors coupled to the body, where the plurality of connectors are adapted to couple to a plurality of respective sockets, and a release structure coupled to the body, where the release structure enables the plurality of connectors to decouple from the plurality of respective sockets. According to the system disclosed herein, the connector assembly facilitates convenient and efficient connection and disconnection of a set of connectors with latches and a set of sockets.

DETAILED DESCRIPTION OF THE INVENTION

The present invention relates to electronic equipment, and more particularly to a connector assembly. The following description is presented to enable one of ordinary skill in the art to make and use the invention, and is provided in the context of a patent application and its requirements. Various modifications to the preferred embodiment and the generic principles and features described herein will be readily apparent to those skilled in the art. Thus, the present invention is not intended to be limited to the embodiment shown, but is to be accorded the widest scope consistent with the principles and features described herein.

A connector assembly is disclosed. The connector assembly includes connectors that are designed to couple to respective sockets, and includes a release structure that enables the connectors to decouple from the respective sockets. According to the system disclosed herein, the connector assembly facilitates convenient and efficient connection and disconnection of a set of connectors with latches and a set of sockets. To more particularly describe the features of the present invention, refer now to the following description in conjunction with the accompanying figures.

Figure 1A:
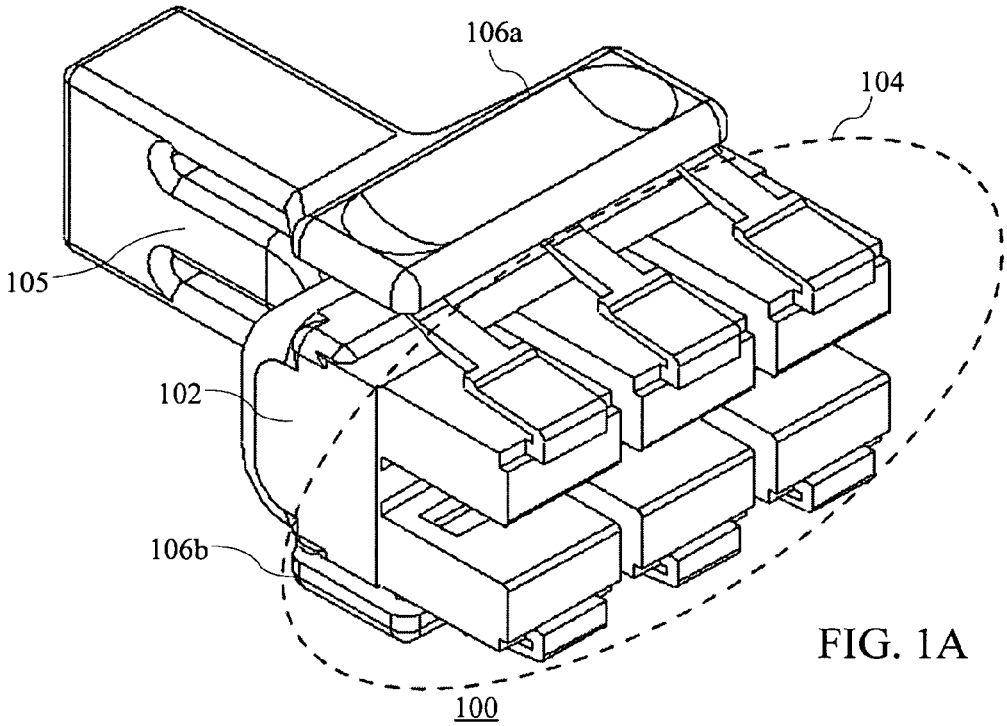
FIG. 1A is a perspective view from the front of a connector assembly, in accordance with the present invention.
Figure 1B:
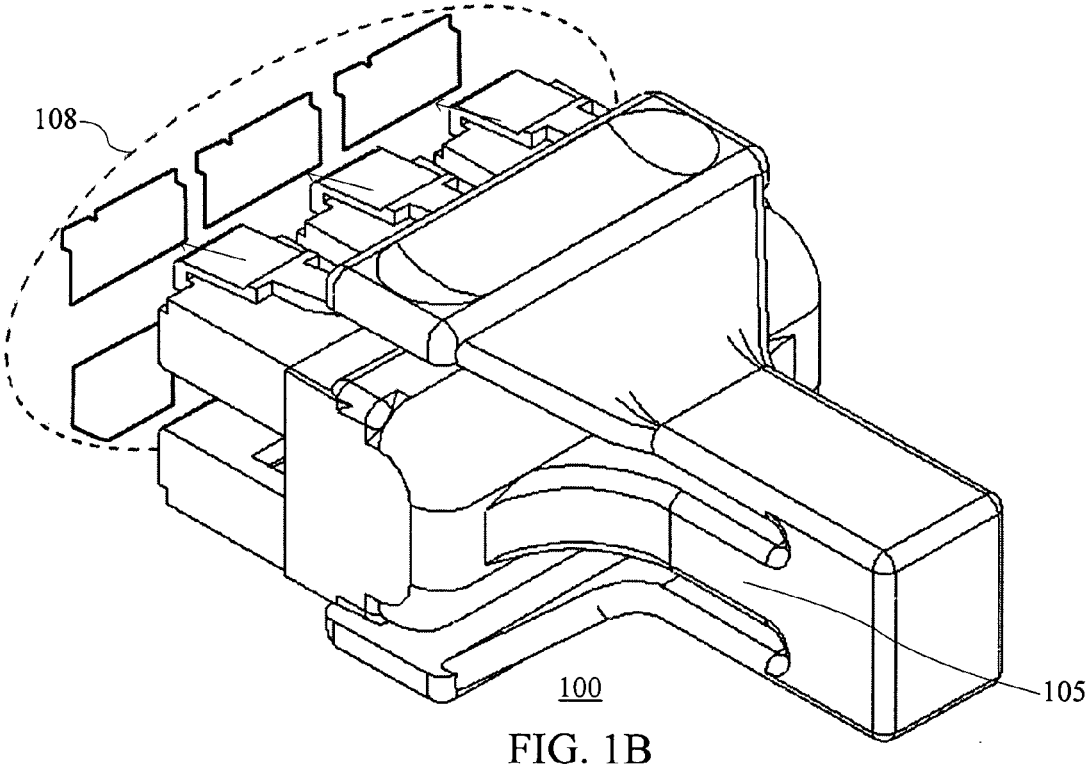
FIG. 1B is another perspective view from the rear of the connector assembly of FIG. 1A, in accordance with the present invention.

FIG. 1A is a perspective view from the front of a connector assembly 100, and FIG. 1B is another perspective view from the rear of the connector assembly 100 of FIG. 1A, in accordance with the present invention. Referring to both FIGS. 1A and 1B together, the connector assembly 100 includes a body 102, connectors 104, and a release structure 106. The release structure 106 includes two release structure components 106*a* and 106*b*. Note that the phrase release structure 106 is used interchangeably with the phrase structure components 106*a* and 106*b*. The connectors 104 are substantially identical and grouped in a ganged array.

Figure 1C:
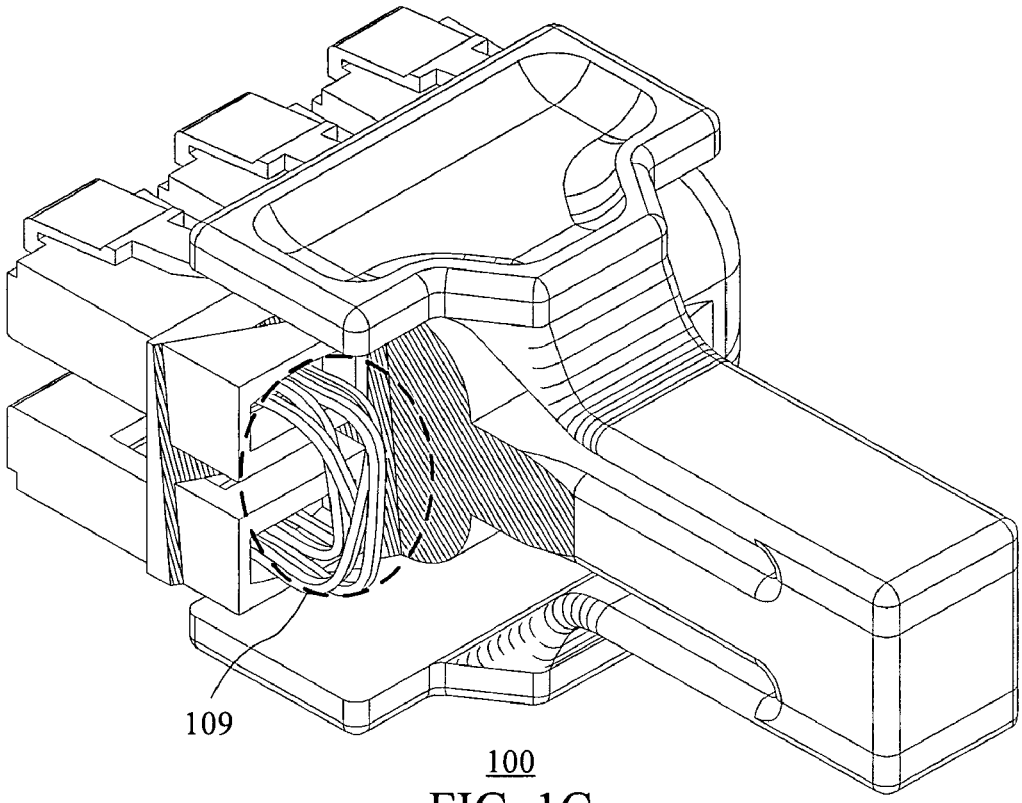
FIG. 1C is a perspective view from the rear of the connector assembly of FIG. 1B with cables exposed, in accordance with the present invention.

FIG. 1C is a perspective view from the rear of the connector assembly 100 of FIG. 1B with cables 109 exposed, in accordance with the present invention. The connectors 104 are coupled by the cables 109 either to other connectors or to external junction points such as test equipment, individual connectors, or another ganged array of connectors.

Figure 1D:
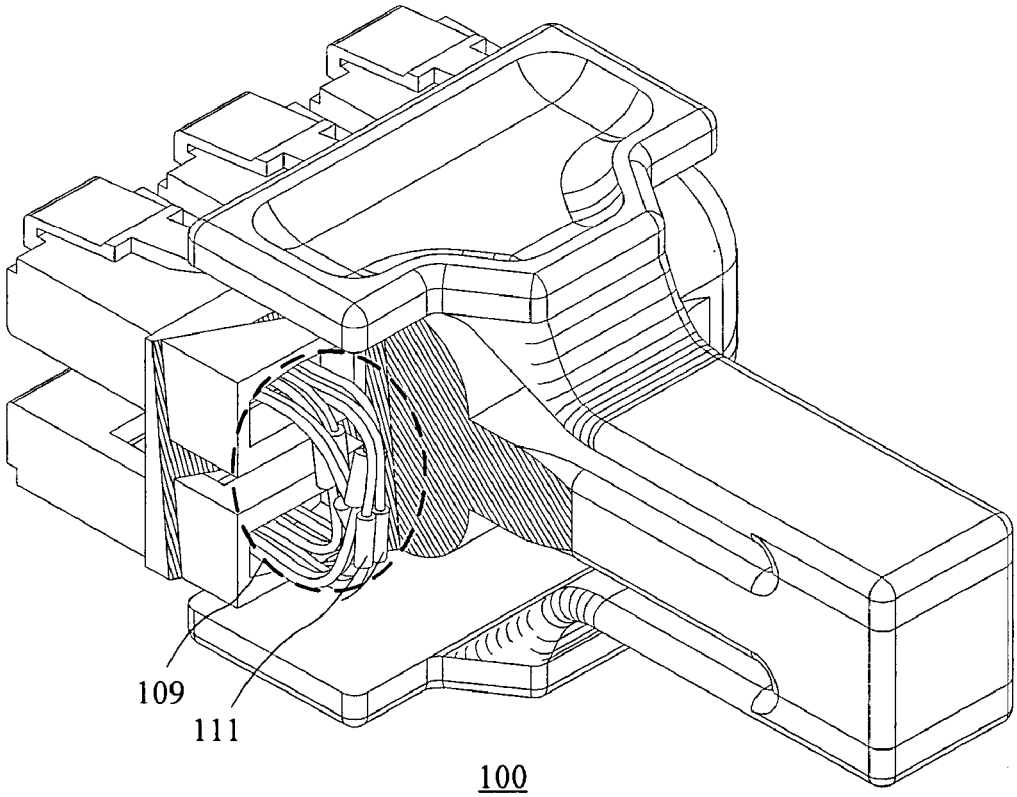
FIG. 1D is a perspective view from the rear of a connector assembly with cables and attenuating elements exposed, in accordance with another embodiment of the present invention.

FIG. 1D is a perspective view from the rear of a connector assembly with internal cables 109 and attenuating elements 111 exposed, in accordance with another embodiment of the present invention. The attenuating elements 111 may be utilized to simulate the loading/losses of a network. In a specific embodiment, the attenuating elements 111 may be implemented with resistors. Alternatively, the attenuating elements 111 may be implemented with a resistor-capacitor-inductor (RLC) circuit. Alternatively, the attenuating elements 111 may be implemented with attenuating fiber elements such as induced radius bends, air gaps, offset splices, etc.

Referring again to FIG. 1C, in a specific embodiment, one or more of the connectors 104 includes a second connector secured to one end of a cable, where the other end of the cable couples to one or more of the other connectors within the body 102. The other end of the cable can also couple to all of the cables within the body 102.

In a specific embodiment, the connectors 104 are RJ45 connectors. Although the present invention is described in the context of RJ45 connectors, one of ordinary skill in the art will readily recognize that the connectors can be any type connectors, and their use would be within the spirit and scope of the present invention. For example, any latching electrical or fiber optic connector may be used.

In a specific embodiment, the connectors 104 are positioned such that some are in a first row and some are in a second row, where the first and second rows are stacked. In a specific embodiment, the connectors 104 are secured between two halves of the body. The release structure components 106*a* and 106*b* are positioned on opposite sides of the body 102 such that one release structure component 106*a* corresponds to the first row of connectors and the other release structure component 106*b* corresponds to the other row of connectors.

Although the present invention disclosed herein is described in the context of two rows of three connectors each, the present invention may apply to other configurations of connectors, and still remain within the spirit and scope of the present invention.

The structure of the body 102 is designed such that the connectors 104 may readily couple to (i.e. be inserted into, or "mated" with) corresponding sockets 108. Each connector 104 has one portion that is secured to the body and has another portion, for engaging with a corresponding socket 108, extending from the body. The sockets 108 are substantially identical and grouped in a ganged array; and the spatial relationship of the connectors 106 corresponds to the spatial relationship of the sockets 108. When the connectors 104 are coupled to the corresponding sockets 108, electrical connections between the connectors 104 and the corresponding sockets 108 are also formed. The body 102 includes a rearward extension 105. One function of the rearward extension 105 is to provide a clearance from components of a device under test.

In operation, the connectors 104 are inserted into the corresponding sockets 108. The ganged array configuration facilitates the ease of inserting the entire array of connectors 104 simultaneously into the corresponding sockets 106.

The release structure 106 enables the connectors 104 to decouple from the respective sockets 108. Specifically, a normal action of one release structure component 106*a* enables the one row of connectors 104 to decouple from the respective sockets 108, and normal action of the other release structure component 106*b* enables the other one row of connectors 104 to decouple from the respective sockets 108. The structure and operation of the connection assembly 100 are described in more detail below.

Figure 1E:
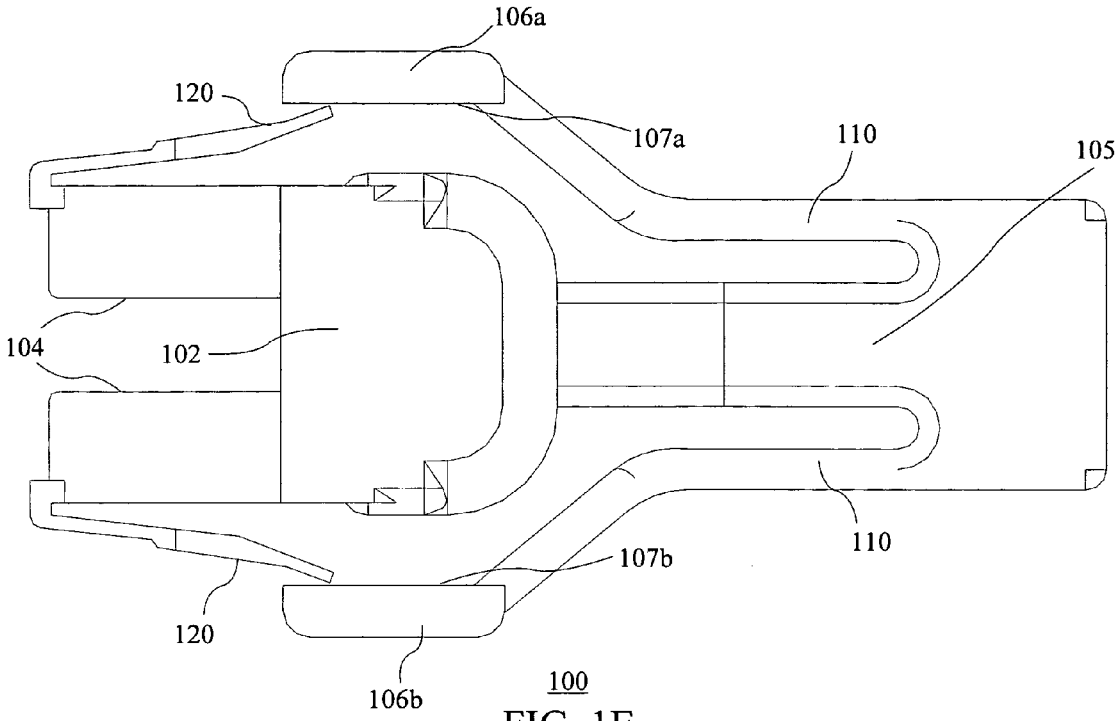
FIG. 1E is a side view of the connector assembly of FIG. 1A in a first position, in accordance with the present invention.
Figure 1F:
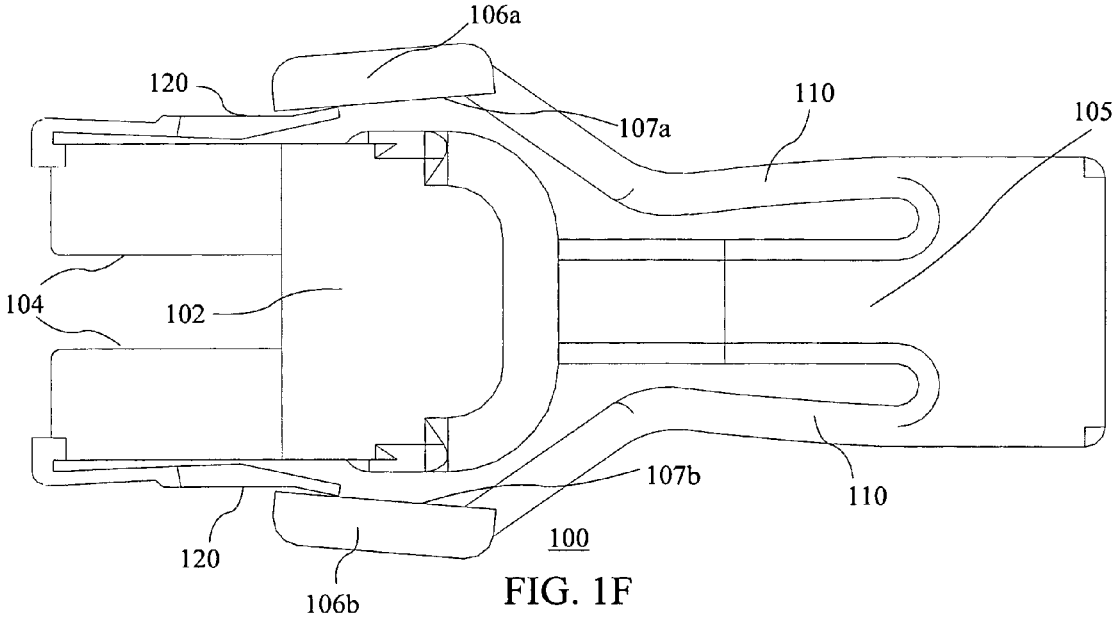
FIG. 1F is a side view of the connector assembly of FIG. 1A in a second position, in accordance with the present invention.

FIG. 1E is a side view of the connector assembly 100 of FIG. 1A in a first position, and FIG. 1F is a side view of the connector assembly 100 of FIG. 1A in a second position, in accordance with the present invention. Referring to both FIGS. 1E and 1E together, the connector assembly 100 also includes latches 120. In a specific embodiment, the latches 120 are on opposing sides of the connectors 104. In operation, when the connectors 104 are inserted into the corresponding sockets 108 (FIG. 1B), each latch 120 secures a respective connector 104 to a respective socket 108 by actuating and locking each mating connector-socket pair together, assuring a positive electrical connection.

The release structure 106 is adapted to cause the latches 120 to release the respective connectors 104 from the respective sockets 108. Referring specifically to FIG. 1E, when the release structure 106 is at rest, its release structure components 106*a* and 106*b* are positioned proximate to the latches 120. The release structure 106 is activated (e.g. depressed) when the ganged array of connectors 104 needs to be removed from the sockets 108. Referring specifically to FIG. 1F, the release structure components 106*a* and 106*b* include bearing surfaces 107*a* and 107*b*, respectively. The release structure 106, when activated, is adapted to depress the latches 120 to release the respective connectors 104 from the respective sockets 108. Specifically, the bearing surfaces 107*a* and 107*b* push against and depress the latches 120. When the latches 120 are depressed by the release structure 106, the latches 120 are depressed substantially simultaneously. This enables the connectors 104 to release from the sockets 108 substantially at the same time facilitating their removal. Also, when the release structure 106 is activated (e.g. depressed), the release structure 106 simultaneously holds the latches 120 in a disengaged position.

In a specific embodiment, when a user grips and squeezes the connector assembly 100, the user's hand naturally grips and squeezes the release structure 106, thereby depressing the release structure 106. This simultaneously disengages the latches 120 of all of the connectors 104, and facilitates the release of the connectors 104 from the corresponding sockets 108. A benefit of the present invention is that the release structure 106 can be activated with the use of one hand of the user.

The body 102, the connectors 104, and the release structure 106 are preferably formed of injection-molded plastic. One of ordinary skill in the art will readily recognize that other materials can be used, and their use would be within the spirit and scope of the present invention. The material used is preferably flexible enough to permit the movement of the release structure components 106*a* and 106*b* at their flex areas 110. The material used is also preferably rigid enough to fully depress all of the latches 120 substantially simultaneously. The rearward extension 105 allows for longer flex areas 110. This allows the release structure components 106*a* and 106*b* to travel further while minimizing stress on the flex areas 110, since amount of flex at the flex areas 110 is minimized.

The body 102, the connectors 104, and the release structure 106 can be molded/cast separately, cast together in any combination, or cast as one single piece. Where the body 102, the connectors 104, and the release structure 106 are cast together, the cost to make the connector assembly 100 drops. As such, the connector assembly 100 may be disposable due to the low cost manufacture. Where one or more of the body 102, the connectors 104, and/or the release structure 106 are cast separately, they are permanently bonded together. Alternatively, the connectors 104 and the release structure 106 can be removably bonded to the body with securing hardware or a coupling means such as latches molded into the body casting.

In a specific embodiment, a dual-durometer casting may be used. As such, a more rigid material can be used to form the bearing surfaces 107*a* and 107*b* and other portions of the release structure components 106*a* and 106*b*, and a more flexible material can be used to form the flex areas 110.

In a specific embodiment of the present invention, the body 102 is cast from a non-rigid material. As such, the connectors 104 are held in accurate spatial alignment, while still allowing for some movement to permit the accurate mating between the connectors 104 and the corresponding sockets 108. This allows for variations in spatial alignment between different sockets 108 that have similar but not identical spacing. Accordingly, this enables the connector assembly 100 to be compatible with sockets 108 having slightly different spacing from the connectors 104. This feature is beneficial in that the same connector assembly can be compatible with sockets made by different manufacturers. This embodiment is readily manufactured by means of either integral casting of the entire assembly in a single piece or multiple pieces (e.g. 5 pieces) that can be bonded, snapped, or otherwise secured together.

Because of the tendency of the non-rigid material to return the connectors 104 to the same position, the connectors 104 would always return to the same spacing. The spacing of the connectors 104 in the resting state is preferably at the center of the tolerance range of the corresponding sockets 108 to which the connectors 104 are to be mated. As a result, the connectors 104 would not stay at either extreme of the tolerance range, but would instead return to center when not connected. Upon insertion into the sockets 108, the flexibility of the body 102 allows the distance between the connectors 104 to increase or decrease as required to accommodate variations in spacing between connectors 104. This ensures ease of insertion into any of the corresponding sockets 108 to which the connector 104 is to be connected.

Additionally, in a preferred embodiment where the connector assembly 100 is cast integrally with the connectors 104 and cables, the resulting ganged array of connectors 104 is extremely robust, as all of the elements (i.e. cables) are encapsulated and thus protected from vibration and flexural stresses during use.

Figure 2A:
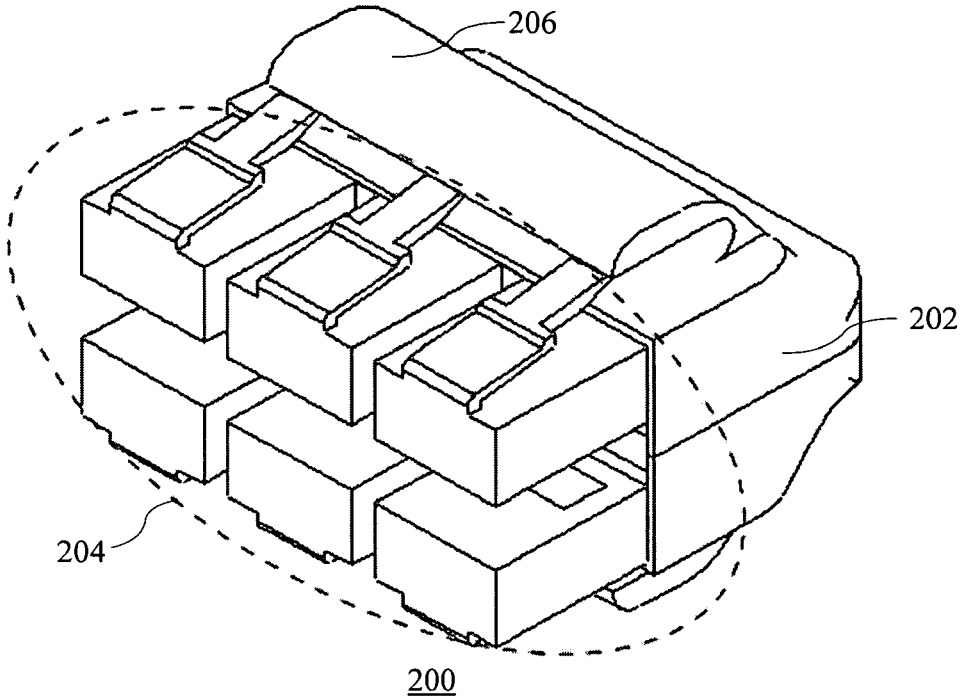
FIG. 2A is a perspective view from the front of a connector assembly, in accordance with another embodiment of the present invention.
Figure 2B:
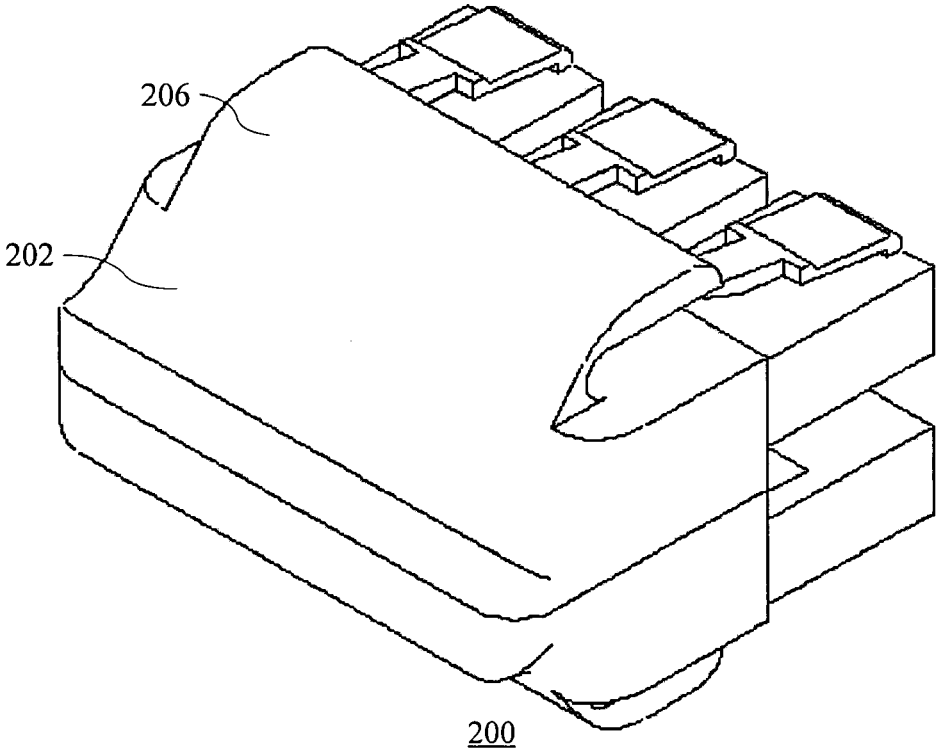
FIG. 2B is another perspective view from the rear of the connector assembly of FIG. 2A, in accordance with the present invention.

FIG. 2A is a perspective view from the front of a connector assembly 200, and FIG. 2B is another perspective view from the rear of the connector assembly 200 of FIG. 2A, in accordance with the present invention. As shown in FIGS. 2A and 2B, the connector assembly 200 includes a body 202, connectors 204, and a release structure 206. The components of the connector assembly 200 can be cast separately, cast together in any combination, or cast as one single piece.

Figure 2C:
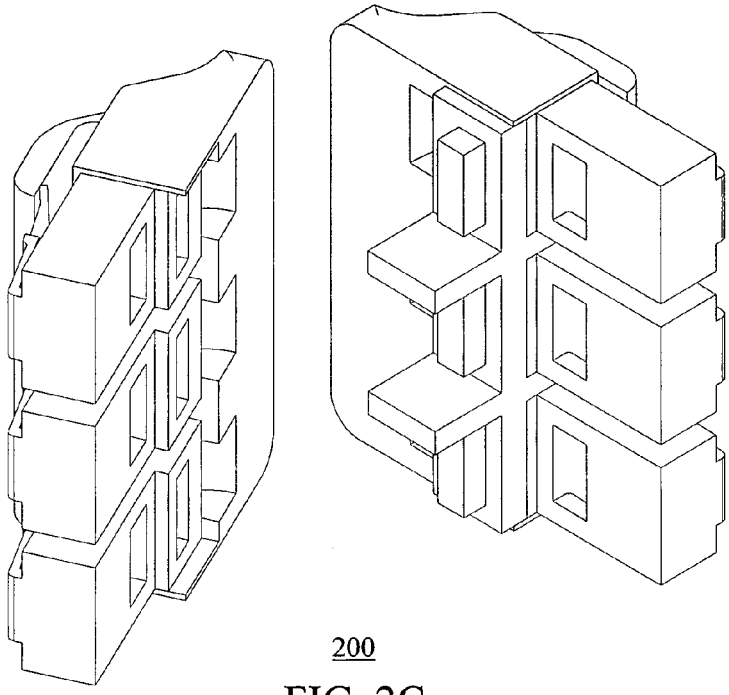
FIG. 2C is an exploded view of the connector assembly of FIG. 2A where the body, connectors, and a central support are cast separately, in accordance with the present invention.
Figure 2D:
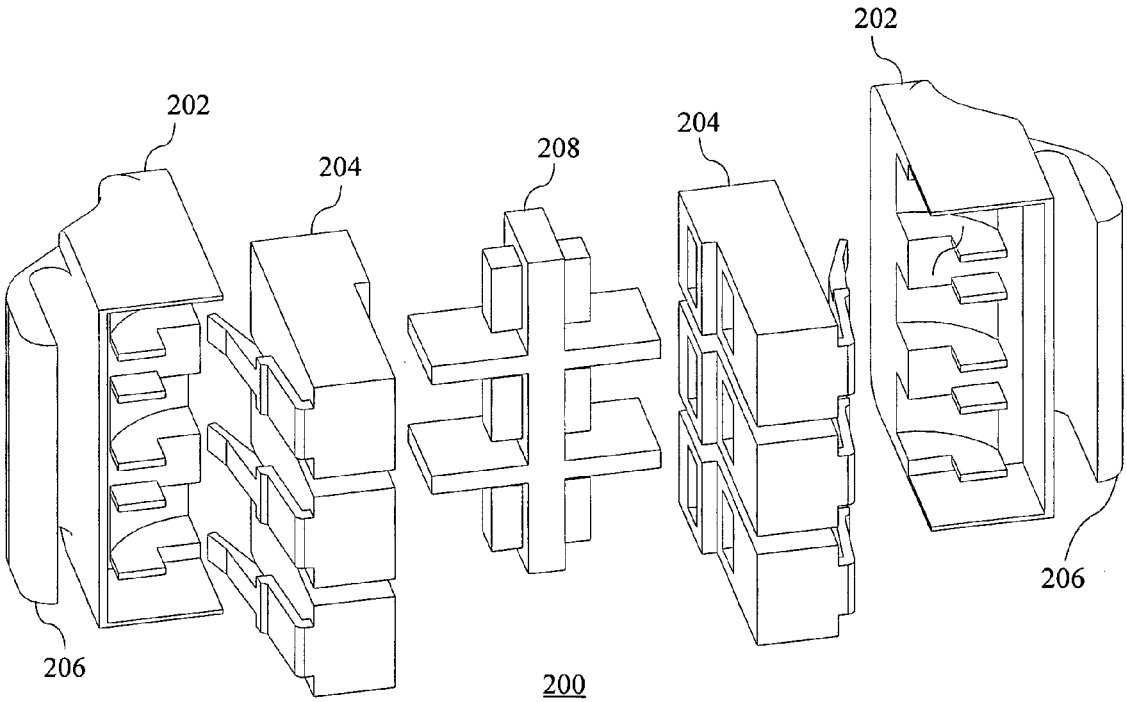
FIG. 2D is another exploded view of the connector assembly of FIG. 2A where the body, connectors, and a central support are cast separately, in accordance with the present invention.

FIG. 2C is an exploded view of the connector assembly 200 of FIG. 2A where the body, connectors, and a central support are cast separately, in accordance with the present invention. FIG. 2D is another exploded view of the connector assembly of FIG. 2A where the body 202, connectors 204, and a central support 208 are cast separately, in accordance with the present invention. In this specific embodiment, each half of the body 202 is cast together with one half of the release structure 206. The center support 208 engages, secures, and locates the connectors 204. The components of the connector assembly 200 (e.g. the body 202, connectors 204, the release structure 206, and a central support 208) may be permanently assembled with adhesive, plastic welding, or removably assembled with hardware.

Figure 3:
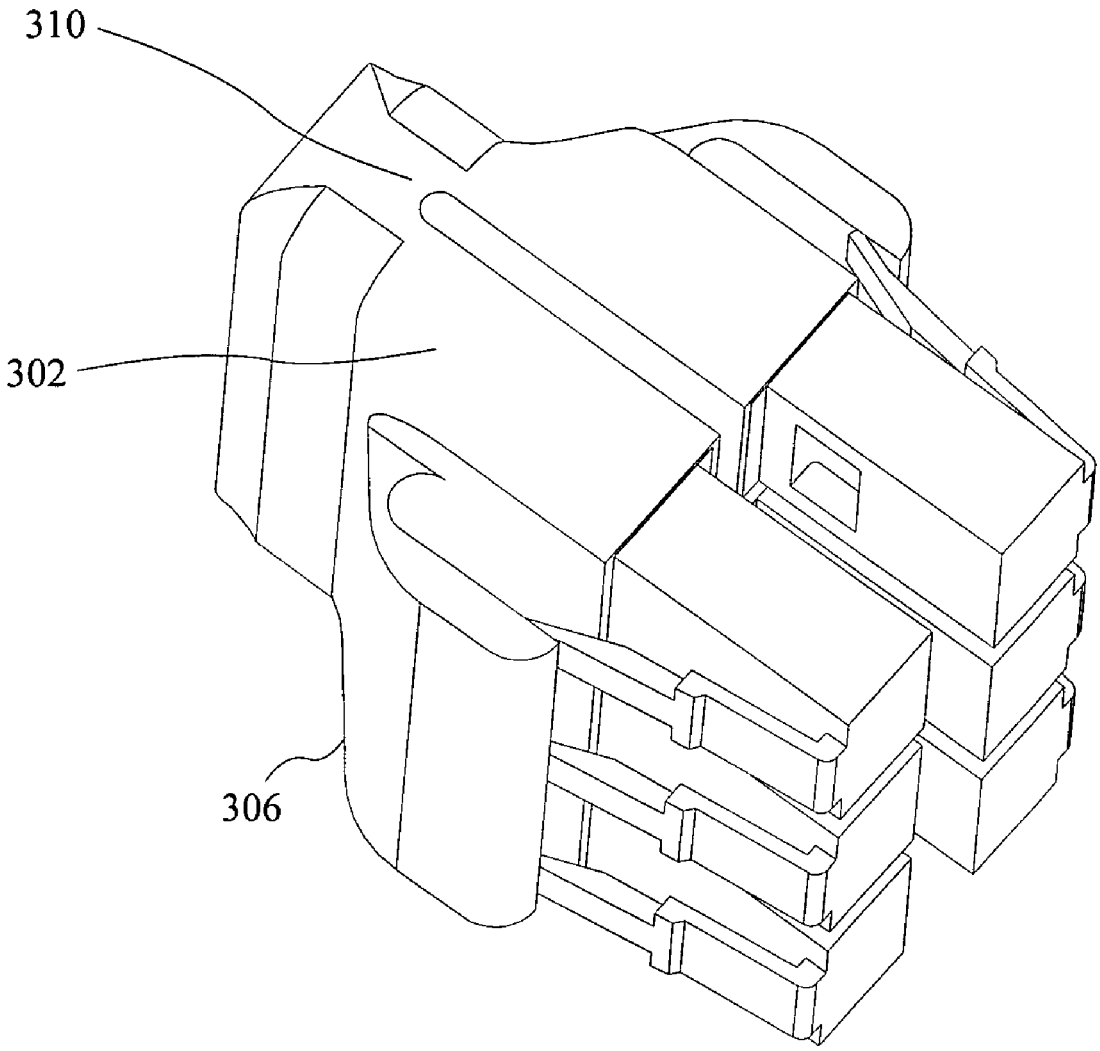
FIG. 3 is a perspective view of a connector assembly utilizing an integral cast body and release structure, in accordance with another embodiment of the present invention.

FIG. 3 is a perspective view of a connector assembly 300 utilizing an integrally cast body 302 and release structure 306, in accordance with another embodiment of the present invention. The body 302 is cast with a readily flexible, non-rigid material and includes a slot 310 to facilitate the flexure of the body 302.

Although the present invention is described in the context of six connectors and six sockets, one of ordinary skill in the art will readily recognize that there could be any number of connectors and sockets, and such numbers would be within the spirit and scope of the present invention.

Figure 4A:
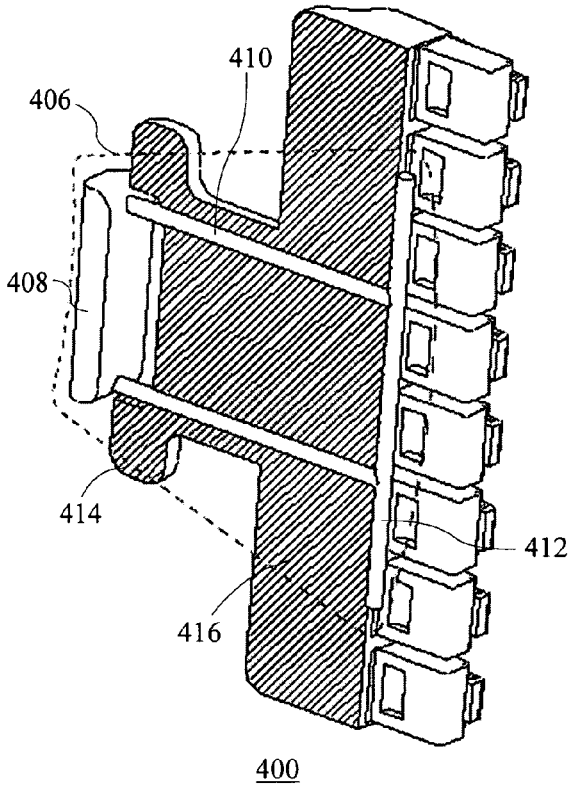
FIG. 4A is a sectioned perspective view of a connector assembly in a first position, in accordance with another embodiment of the present invention.
Figure 4B:
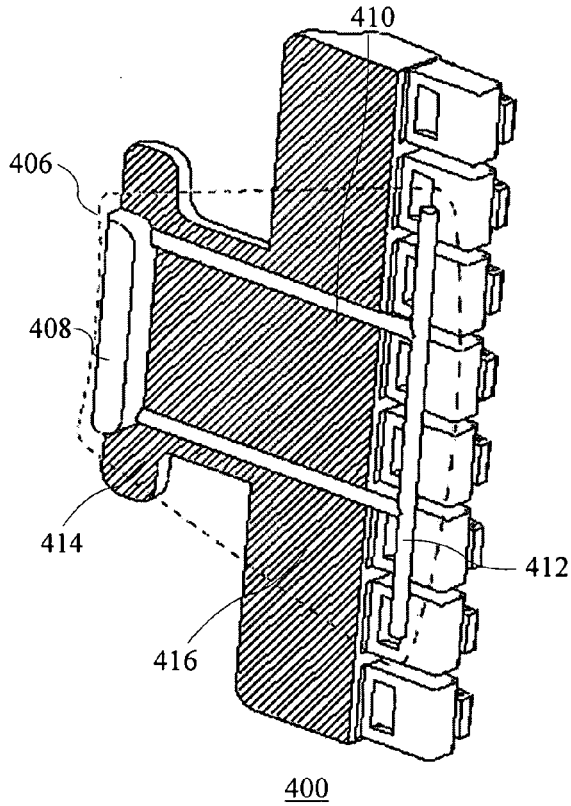
FIG. 4B is a sectioned perspective view of a connector assembly in a second position, in accordance with the present invention.

FIG. 4A is a sectioned perspective view of a connector assembly 400 in a first position, and FIG. 4B is a sectioned perspective view of a connector assembly 400 in a second position, in accordance with another embodiment of the present invention. The connector assembly 400 includes a release structure 406 that has a handle 408, a push bar 410, and a release bar 412. The release structure 406 is used for applications with more than 8 connectors 404. In this specific embodiment, there are 16 connectors 404. Only eight connectors 404 are shown, as only half of the connector assembly 400 is shown. The number of connectors may vary and the specific number will depend on the specific application.

In operation, one or two hands of the user can be used to operate the connector assembly 400. Preferably two hands are used. As such, the latches are depressed with one hand and the handle 414 of the connector assembly 400 is gripped with the fingers of the second hand, while the handle 408 is pressed with the thumb of the second hand. The push bar 410 and the release bar 412 moves forward relative to the body 416 and bears against the face of the corresponding ganged array of sockets, effecting ejection.

This embodiment is beneficial because as the number of connectors increases, the amount of force required to insert or extract the ganged array of connectors from a corresponding ganged array of sockets increases. Although insertion of even a large number of connectors can normally be effected by several means, extraction can be problematic, both in terms of the physical strength required, and the risk of causing undue stress to the components to which the sockets are mounted.

Figure 5:
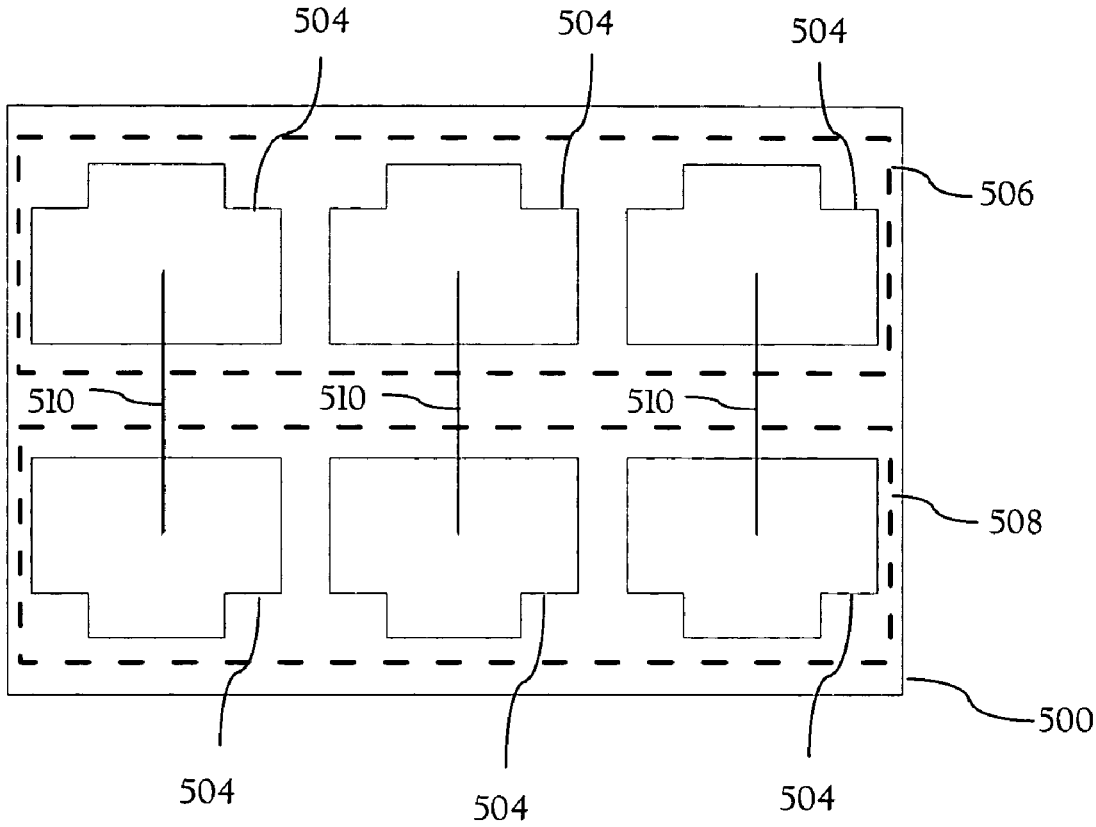
FIG. 5 is a view of an inline connector assembly, in accordance with the present invention.

FIG. 5 is a view of an inline connector assembly 500, in accordance with the present invention. The inline connector assembly 500 includes connectors 504 arranged in two rows 506 and 508. As shown, the connectors 504 are configured similarly to the connectors 104 of FIGS. 1A to 3. In other words, the row 506 is inline with the row 508. The inline connector assembly 500 is also referred to as a 2×3 inline connector assembly, because there are two rows 506 and 508, each having three connectors 504, where the connectors 504 from one row 506 are inline with the connectors 504 of the other row 508. The 2×3 inline connector assembly 500 may be used with a corresponding 2×3 inline receiver assembly (not shown). In the specific embodiment shown, each connector 504 from the row 506 is coupled to a respective connector 504 of the row 508 via internal cables 510. The internal connection schemes may vary depending on the specific implementation.

Although the present invention is described in the context of inline connectors assemblies, one of ordinary skill in the art will readily recognize that there could be any number of configurations, and such configurations would be within the spirit and scope of the present invention.

Figure 6:
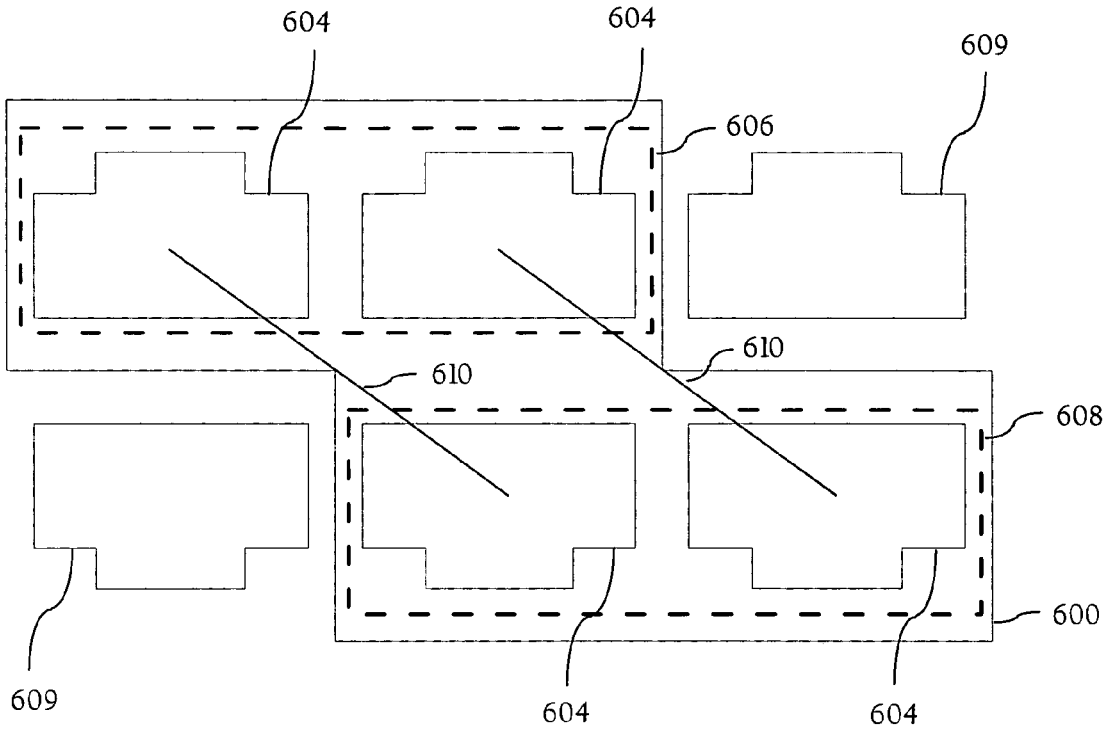
FIG. 6 is a view of an offset connector assembly, in accordance with another embodiment of the present invention.

FIG. 6 is a view of an offset connector assembly 600, in accordance with another embodiment of the present invention. The offset connector assembly 600 includes connectors 604 arranged in two rows 606 and 608. As shown, the row 606 is offset from the row 608. The offset connector assembly 600 is used in conjunction with connectors 609, which are external to the connector assembly 600. The offset connector assembly 600 is also referred to as a 2×2 offset connector assembly, because there are two rows 606 and 608, each having two connectors 604, where the connectors 604 from one row 606 are offset with the connectors 604 of the other row 608. The 2×2 offset connector assembly 600 in combination with the connectors 609 may be used with a corresponding 2×3 offset receiver assembly (not shown). In the specific embodiment shown, each connector 604 from the row 606 is coupled to a respective connector 604 of the row 608 via internal cables 610. The internal connection schemes may vary depending on the specific implementation. Also, the connectors 609 may couple to the connectors 604 or to any external circuit, in any combination or connection scheme.

Figure 7:
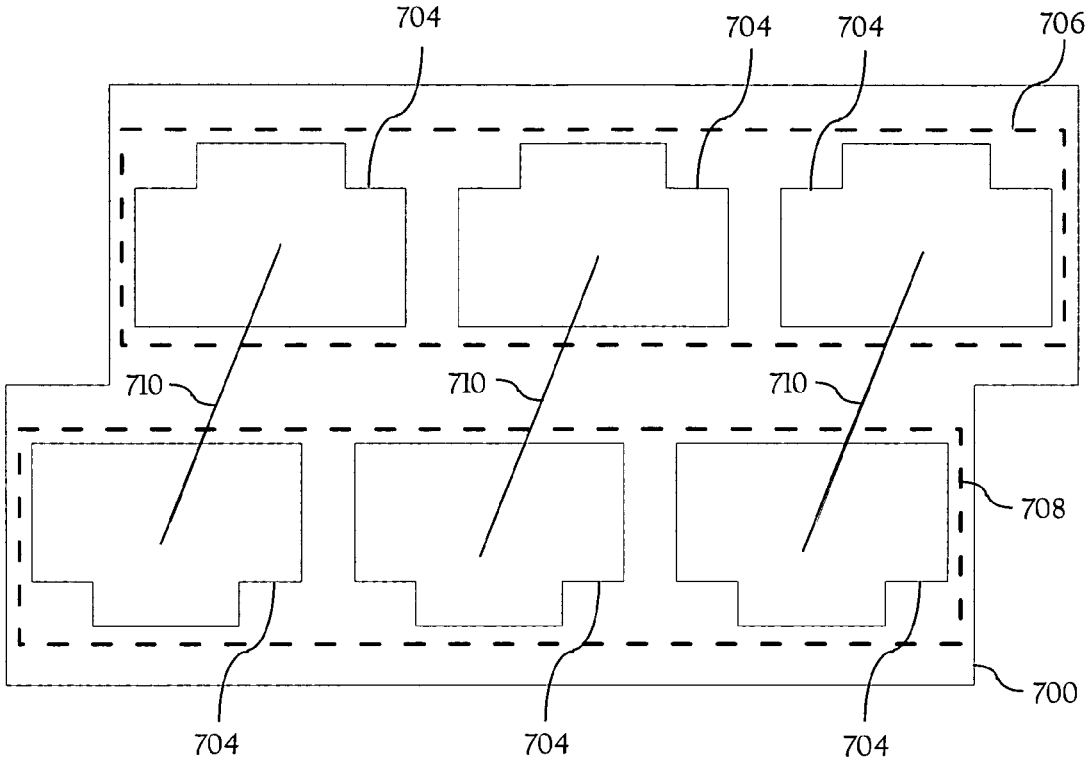
FIG. 7 is a view of a staggered connector assembly, in accordance with another embodiment of the present invention.

FIG. 7 is a view of a staggered connector assembly 700, in accordance with another embodiment of the present invention. The staggered connector assembly 700 includes connectors 704 arranged in two rows 706 and 708. As shown, the rows 706 and 708 are staggered. The staggered connector assembly 700 is also referred to as a 2×3 staggered connector assembly, because there are two rows 706 and 708, each having three connectors 704, where the connectors 704 from one row 706 are staggered from the connectors 704 of the other row 708. The 2×3 staggered connector assembly 700 may be used with a corresponding 2×3 staggered receiver assembly (not shown). In the specific embodiment shown, each connector 704 from the row 706 is coupled to a respective connector 704 of the row 708 via internal cables 710.

A connector assembly has been disclosed. The connector assembly includes connectors that are adapted to couple to respective sockets, and includes a release structure that enables the connectors to decouple from the respective sockets. According to the system disclosed herein, the connector assembly facilitates convenient and efficient connection and disconnection of a set of connectors with latches and a set of sockets.

The present invention has been described in accordance with the embodiments shown. One of ordinary skill in the art will readily recognize that there could be variations to the embodiments, and that any variations would be within the spirit and scope of the present invention. Accordingly, many modifications may be made by one of ordinary skill in the art without departing from the spirit and scope of the appended claims.

What is claimed is:

1. A connector assembly comprising:

a body comprising a rear extension;

a plurality of connectors coupled to the body, wherein the plurality of connectors is adapted to couple to a plurality of respective sockets; and a release structure having a first flex area and a second flex area, wherein the first flex area and the second flex area are coupled to the rear extension, wherein the release structure enables the plurality of connectors to decouple from the plurality of respective sockets, and wherein the rear extension comprises an end that extends away from the plurality of sockets, and wherein the first flex area and the second flex area are coupled to the end of the rear extension.

2. The assembly of claim 1 further comprising:

a plurality of latches coupled to the plurality of connectors, wherein each latch of the plurality of latches secures a respective connector of the plurality of connectors to a respective socket of the plurality of sockets, and wherein the release structure is adapted to cause the plurality of latches to release the plurality of respective connectors from the respective plurality of sockets.

3. The assembly of claim 1 wherein the release structure, when activated, is adapted to depress the plurality of latches to release the plurality of respective connectors from the respective plurality of sockets.

4. The assembly of claim 1 wherein the release structure is activated by being depressed.

5. The assembly of claim 1 wherein the plurality of latches are depressed by the release structure substantially simultaneously.

6. The assembly of claim 1 wherein each connector has a first portion that is secured to the body and has a second portion for engaging with a corresponding socket, wherein the second portion extends from the body.

7. The assembly of claim 1 wherein the connectors have a spatial relationship that corresponds to a spatial relationship of the sockets.

8. The assembly of claim 1 wherein at least one of the plurality of connectors includes a second connector secured to a first end of a cable, where a second end of the cable couples to at least one of the other connectors.

9. The assembly of claim 1 wherein the second end of the cable couples to a plurality of other cables.

10. The assembly of claim 1 wherein the body, the plurality of connectors, and the release structure are cast separately.

11. The assembly of claim 1 wherein the body, the plurality of connectors, and the release structure are permanently bonded together.

12. The assembly of claim 1 wherein the body, the plurality of connectors, and the release structure are removably bonded to the body.

13. The assembly of claim 1 wherein the release structure comprises a handle, a push bar, and a release bar.

14. The assembly of claim 1 wherein the rear extension enables longer flex areas.

15. The assembly of claim 1 wherein the body, the plurality of connectors, and the release structure are cast together as a single piece.

16. The assembly of claim 15 wherein dual-durometer casting is used.

17. The assembly of claim 1 wherein the body, the plurality of connectors, and the release structure are cast together in any combination.

18. The assembly of claim 17 wherein dual-durometer casting is used.

19. The assembly of claim 1 wherein the body is cast from a non-rigid material.

20. The assembly of claim 19 wherein the connectors are held in accurate spatial alignment, while still allowing for some movement to permit the accurate mating between the plurality of connectors and the respective plurality of sockets.

21. The assembly of claim 1 further comprising a plurality of attenuating elements coupled to the plurality of connectors, wherein the plurality of attenuating elements are utilized to simulate at least one of loading and losses of a network.

22. The assembly of claim 21 wherein the plurality of attenuating elements are implemented with at least one of an electrical element and an optical element.

23. The assembly of claim 1 wherein the connectors 104 are secured between two halves of the body.

24. The assembly of claim 1 wherein the release structure comprises:

a first release structure component coupled to the body; and a second release structure component coupled to the body.

25. The assembly of claim 24 wherein the first release structure component and the second release structure component are positioned on opposite sides of the body.

26. The assembly of claim 24 wherein the plurality of connectors comprises:

a first row of connectors; and a second row of connectors.

27. The assembly of claim 26 wherein the first and second rows are stacked.

28. The assembly of claim 26 wherein the first and second rows are inline.

29. The assembly of claim 26 wherein the first and second rows are offset.

30. The assembly of claim 26 wherein the first and second rows are staggered.

31. The assembly of claim 26 wherein the first release structure component corresponds to the first row of connectors, and wherein the first release structure component enables the first row of connectors to decouple from the respective plurality of sockets.

32. The assembly of claim 31 wherein the second release structure component corresponds to the second row of connectors, and wherein the second release structure component enables the second row of connectors to decouple from the respective plurality of sockets.

33. A connector assembly comprising:

a body;

a plurality of connectors coupled to the body, wherein the plurality of connectors is adapted to couple to a plurality of respective sockets; and a release structure coupled to the body, wherein the release structure enables the plurality of connectors to decouple from the plurality of respective sockets, wherein the release structure comprises a handle, a push bar, and a release bar, and wherein when the handle is pressed, the push bar and the release bar move forward relative to the body and against the plurality of sockets to facilitate decoupling the plurality of connectors from the plurality of sockets.

34. The assembly of claim 33 further comprising:

a plurality of latches coupled to the plurality of connectors, wherein each latch of the plurality of latches secures a respective connector of the plurality of connectors to a respective socket of the plurality of sockets, and wherein the release structure is adapted to cause the plurality of latches to release the plurality of respective connectors from the respective plurality of sockets.

35. The assembly of claim 33 wherein the release structure, when activated, is adapted to depress the plurality of latches to release the plurality of respective connectors from the respective plurality of sockets.

36. The assembly of claim 33 wherein the plurality of latches are depressed by the release structure substantially simultaneously.

37. The assembly of claim 33 wherein each connector has a first portion that is secured to the body and has a second portion for engaging with a corresponding socket, wherein the second portion extends from the body.

38. The assembly of claim 33 wherein the connectors have a spatial relationship that corresponds to a spatial relationship of the sockets.

39. The assembly of claim 33 wherein the body, the plurality of connectors, and the release structure are cast together as a single piece.

40. The assembly of claim 33 wherein dual-durometer casting is used.

41. The assembly of claim 33 wherein the body, the plurality of connectors, and the release structure are cast separately.

42. The assembly of claim 33 wherein the body, the plurality of connectors, and the release structure are permanently bonded together.

43. The assembly of claim 33 wherein the plurality of connectors and the release structure are removably bonded to the body.

44. The assembly of claim 33 wherein the body, the plurality of connectors, and the release structure are cast together in any combination.

45. The assembly of claim 44 wherein dual-durometer casting is used.

46. The assembly of claim 33 wherein the body is cast from a non-rigid material.

47. The assembly of claim 46 wherein the connectors are held in accurate spatial alignment, while still allowing for some movement to permit the accurate mating between the plurality of connectors and the respective plurality of sockets.

48. The assembly of claim 33 further comprising a plurality of attenuating elements coupled to the plurality of connectors, wherein the plurality of attenuating elements are utilized to simulate at least one of loading and losses of a network.

49. The assembly of claim 48 wherein the plurality of attenuating elements are implemented with at least one of an electrical element and an optical element.

* * * * *